US007708073B2

(12) United States Patent
Richard et al.

(10) Patent No.: US 7,708,073 B2
(45) Date of Patent: May 4, 2010

(54) HEAT GENERATOR FOR SCREEN DEPLOYMENT

(75) Inventors: Bennett M. Richard, Kingwood, TX (US); Paul M. McElfresh, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 36 days.

(21) Appl. No.: 12/042,499

(22) Filed: Mar. 5, 2008

(65) Prior Publication Data

US 2009/0223678 A1 Sep. 10, 2009

(51) Int. Cl.
*E21B 43/24* (2006.01)

(52) U.S. Cl. ..... 166/302; 166/228

(58) Field of Classification Search ..... 166/228, 166/302
See application file for complete search history.

(56) References Cited

U.S. PATENT DOCUMENTS

| | | | | |
|---|---|---|---|---|
| 3,420,363 | A * | 1/1969 | Blickensderfer | 206/524 |
| 4,178,993 | A | 12/1979 | Richardson et al. | |
| 4,219,083 | A | 8/1980 | Richardson et al. | |
| 4,237,973 | A * | 12/1980 | Todd | 166/59 |
| 4,289,633 | A | 9/1981 | Richardson et al. | |
| 4,330,037 | A | 5/1982 | Richardson et al. | |
| 4,456,069 | A | 6/1984 | Vigneri | |
| 4,475,596 | A | 10/1984 | Papst | |
| 4,515,213 | A * | 5/1985 | Rogen et al. | 166/123 |
| 4,706,751 | A | 11/1987 | Gondouin | |
| 5,049,591 | A * | 9/1991 | Hayashi et al. | 521/159 |
| 5,190,109 | A | 3/1993 | Pardo | |
| H1948 | H | 3/2001 | Rusek et al. | |
| 6,431,282 | B1 * | 8/2002 | Bosma et al. | 166/288 |
| 6,457,533 | B1 | 10/2002 | Metcalfe | |
| 6,583,194 | B2 * | 6/2003 | Sendijarevic | 521/172 |
| 6,837,759 | B2 | 1/2005 | Van-Drentham Susman | |
| 6,935,432 | B2 * | 8/2005 | Nguyen | 166/387 |
| 7,013,979 | B2 | 3/2006 | Richard | |

(Continued)

FOREIGN PATENT DOCUMENTS

WO 2005075342 A1 8/2005

OTHER PUBLICATIONS

T. Shelley, "Steaming Ahead," Eureka, May 11, 2007 (3 pp), available from http://www.eureka.magazine.co.uk/article/11693/Steaming-ahead.asp.

*Primary Examiner*—David J Bagnell
*Assistant Examiner*—Blake Michener
(74) *Attorney, Agent, or Firm*—Mossman Kumar & Tyler PC

(57) ABSTRACT

A screen assembly has a material that conforms to the borehole shape after insertion. The assembly comprises a compliant layer that takes the borehole shape on expansion. The outer layer is formed having holes to permit production flow. The selected conforming material swells with heat, and in one non-limiting embodiment comprises a shape memory foam that is thermoset or thermoplastic. Heat is provided by supplying a fuel (including an oxidant) to a catalyst in close proximity to the compliant layer so that the product from the catalytic reaction is heated steam which contacts and deploys the conforming material. The base pipe can have a screen over it to act as an underlayment for support of the conforming layer or alternatively for screening.

21 Claims, 4 Drawing Sheets

U.S. PATENT DOCUMENTS

| | | | | |
|---|---|---|---|---|
| 7,243,732 | B2 * | 7/2007 | Richard | 166/387 |
| 7,318,481 | B2 | 1/2008 | Richard | |
| 2004/0164499 | A1 * | 8/2004 | Murakami et al. | 277/628 |
| 2005/0205263 | A1 * | 9/2005 | Richard | 166/369 |
| 2006/0081374 | A1 | 4/2006 | Bland et al. | |
| 2006/0260814 | A1 * | 11/2006 | Pfefferle | 166/303 |
| 2007/0167532 | A1 * | 7/2007 | Xiao | 518/702 |
| 2007/0246228 | A1 | 10/2007 | Richard | |
| 2008/0087434 | A1 * | 4/2008 | Wilen et al. | 166/312 |

* cited by examiner

HEAT GENERATOR FOR SCREEN DEPLOYMENT

TECHNICAL FIELD

The present invention relates to downhole screens, and more particularly relates, in one non-limiting embodiment, to downhole screens that can be expanded or deployed in response to locally applied heat.

TECHNICAL BACKGROUND

In the past, sand control methods have been dominated by gravel packing outside of downhole screens. The idea was to fill the annular space outside the screen with sized gravel to prevent the production of undesirable solids (sand) from the formation. More recently, with the advent of tubular expansion technology, it was thought that the need for gravel packing could be eliminated if a screen or screens could be expanded in place to eliminate the surrounding annular space that had heretofore been packed with gravel. Problems arose with the screen expansion technique as a replacement for gravel packing because of wellbore shape irregularities. A fixed swage would expand a screen only a fixed amount. Problems still included that a washout in the wellbore would still leave a large annular space outside the screen. Conversely, a tight spot in the wellbore could create the risk of sticking the fixed swage.

One improvement of the fixed swage technique was to use various forms of flexible swages. In theory, these flexible swages were compliant so that in a tight spot they would flex inwardly and reduce the chance of sticking the swage. On the other hand, if there was a void area, the same problem persisted in that the flexible swage had a finite outer dimension to which it would expand the screen. Therefore, the use of flexible swages still left the potential problem of annular gaps outside the screen with a resulting undesired production of solids when the well was put on production from that zone.

Prior designs of screens have used a pre-compressed mat held by a metal sheath that is then subjected to a chemical attack when placed in the desired location downhole. The mat is then allowed to expand from its pre-compressed state. The screen per se is not expanded. This design is described in U.S. Pat. Nos. 2,981,332 and 2,981,333. U.S. Pat. No. 5,667,011 shows a fixed swage expanding a slotted liner downhole. U.S. Pat. Nos. 5,901,789 and 6,012,522 show well screens being expanded. U.S. Pat. No. 6,253,850 shows a technique of inserting one solid liner in another already expanded slotted liner to blank it off and the use of rubber or epoxies to seal between the liners. U.S. Pat. No. 6,263,966 shows a screen with longitudinal pleats being expanded downhole. U.S. Pat. No. 5,833,001 shows rubber cured in place to make a patch after being expanded with an inflatable. Finally, U.S. Pat. No. 4,262,744 is of general interest as a technique for making screens using molds.

U.S. Pat. No. 7,318,481 describes a screen assembly that includes a material that conforms to the borehole shape after insertion. The assembly comprises a compliant layer that takes the borehole shape on expansion. The outer layer is formed having holes to permit production flow. The material that is selected preferably swells with heat and in one non-limiting embodiment preferably comprises a shape memory foam that is thermoset. The base pipe may have a screen over it to act as an underlayment for support of the conforming layer or alternatively for screening. The conforming layer can expand by itself or expansion may also occur from within the base pipe. This design could be improved if the expansion of the compliant layer were activated by heat locally at its downhole location to a temperature greater than that experienced by the screen assembly on its trip into the hole. If the compliant layer experiences too much heating in advance of placement, it will deploy prematurely, and in most cases be difficult or impossible to dislodge.

A difficulty with supplying heat downhole by injecting a heated medium is that the heat will be dissipated during transmission and insufficient heat will be delivered to the desired site. Methods are known for providing heat only locally downhole, but they each have difficulties. Downhole heaters, such as electrically-powered heaters, such as a wireline deployed electric heater, or a battery fed heater, may generally lack sufficient power (amperage) to provide the necessary heat for deployment. Downhole combustion processes are also known to generate heat. However, most exothermic oxidation/combustion reactions require temperatures that would compromise mud stability, if not tubular integrity, and would tend to be difficult to initiate and would be problematic to formulate as a liquid or mud for downhole use. Again, initiating the reaction at the surface would tend to expend and dissipate most of the heat before placement in the target or the mud for downhole use. Hydration of acidic electrolytes (such as aluminum chloride, $AlCl_3$) or acids would also generate heat, but would be expected to be corrosive and at high temperatures could compromise the integrity of the tubular goods, tools, screens and other equipment in many circumstances. For instance, hydration of aluminum chloride would produce a product environment of about pH 0.8, as contrasted with using NaOH, which would generally yield a product environment of about pH 14. There are also heat generating reactions that can be timed through control of the reaction rate through manipulation of pH and other methods such as processes like N-SITU developed by Shell Oil Co. This technology is found in U.S. Pat. Nos. 4,178,993; 4,219,083; 4,289,633; and 4,330,037. This method is a surface-mixed reaction that must be carefully timed with pump rate and the like in order for the heat liberation to occur in a specific zone of interest. While this operation can be accomplished by those skilled in the art, unforeseen circumstances can cause last minute disruptions to this scheduled treatment, and the heat can be liberated in an undesired location in the wellbore.

It would thus be very desirable and important to discover a method and apparatus for deploying a compliant layer only at a particular temperature or temperature range at a particular location downhole.

SUMMARY

There is provided, in one form, a well completion method that involves covering at least one base pipe at least partially with a porous conforming material. The base pipe is run in to a desired location in a wellbore with the conforming material. The conforming material is heated to deploy it to bridge an annular gap to a wellbore wall. This may be done without base pipe expansion. The heat is provided locally downhole by a catalytic reaction that produces steam. Finally, fluids are produced through or filtered through the conforming material to the base pipe. In one non-limiting, alternative embodiment the conforming material is not radially constricted.

In another embodiment, there is provided a deployable screen assembly that includes a base pipe covered at least partially with a porous conforming material. The porous conforming material deploys in the presence of heat. A catalyst is provided on the assembly in proximity to the porous conforming material, where the catalyst is capable of generating heat upon contact with a fuel together with an oxidant.

DETAILED DESCRIPTION

It has been discovered that a novel chemical catalyst system may deploy a shape memory foam screen to accomplish the purpose of expanding the screen to bridge an annular gap to a wellbore wall at a relatively precise downhole location. The simplicity and heat generated locally make it a much more attractive alternative than conventional downhole heating devices that lack sufficient amperage to produce the required heat for deployment, or where the heat dissipates from the surface to the deployment site.

The apparatus and method herein addresses the task of providing a sand control screen downhole by providing a screen assembly with an outer layer that can conform to the borehole shape upon expansion. In one non-limiting embodiment, a material is selected that will swell, expand, enlarge or otherwise deploy to further promote filling the void areas in the borehole after expansion. In an alternative design, screen expansion is not required and the outermost layer swells to conform to the borehole shape upon heating. The screen section may be fabricated in a manner that reduces or eliminates welds. Welds are placed under severe loading in an expansion process, so minimizing or eliminating welds provides for more reliable screen operation after expansion.

One of the problems with using shape memory foams as a porous conforming material on the screen assemblies is that it wants to redeploy to its original, larger diameter when it experiences its glass transition temperature (Tg) or higher. It may be difficult to formulate the conforming material to its Tg because the material is too soft at Tg, which collapses the pores and stops flow and filtration through the material with relatively very small pressure differentials. This would defeat the purpose of using it as a screen. Also, since many applications for the screens herein are in horizontal wells, the Tg could be inadvertently and undesirably reached in the vertical section, but the screen may have to travel another 10,000 feet or more, requiring hours of run in. The shape memory foams, which are particularly suitable during and after placement, deploy in minutes at their Tg. Having a conforming material with a higher Tg than the bottom hole temperature where the screen is to be deployed would permit the screen to be located, contacted by heat from a local heat source to deploy the conforming material, to give a rigid, filtration foam when the material is cooled well below its Tg.

These and other advantages of the present method and apparatus will become more apparent to one skilled in the art from a review of the description of them and the claims that appear below.

Figure 1:
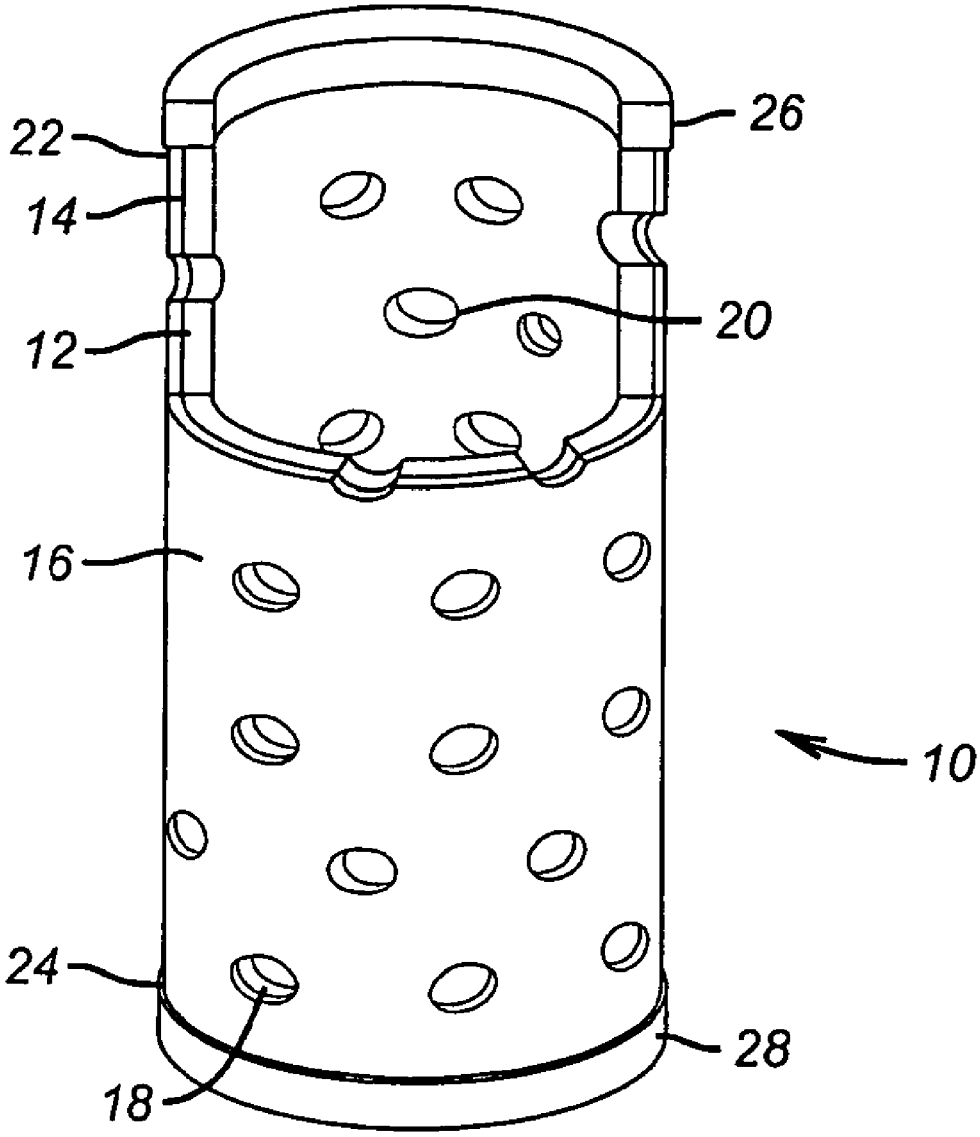
FIG. 1 is a cutaway view of the screen shown in elevation.

FIG. 1 illustrates a portion of a section of a deployable screen assembly 10. It has a base pipe 12 over which is the screen 14 and over which is outer conforming layer 16. Layer 16 has a plurality of holes 18. The base pipe 12 also has holes 20. The actual filter material or screen 14 may be a mesh or a weave or one or more of other known filtration products. One non-limiting type of suitable conforming layer 16 is one that is soft so that it will flow upon optional expansion of the screen 10. In another non-restrictive embodiment, material for the conforming layer 16 is one that will swell when heated. Suitable examples include, but are not necessarily limited to, porous polynitrile, HNBR, VITON® fluoropolymer elastomer, TEFLON® polytetrafluoroethylene, epoxy or polyurethane. In an alternative, particularly suitable embodiment, the conforming layer 16 swells sufficiently after being run into the wellbore, to contact the wellbore, without expansion of the screen 10. Shown schematically at the ends 22 and 24 of screen 10 are stop rings 26 and 28. These stop rings will contain the conforming layer 16 upon optional expansion of screen 10 against running longitudinally in an annular space outside screen 10 after it is expanded. Their use is optional. In one non-limiting, alternative embodiment the conforming material is not radially constricted.

Figure 2:
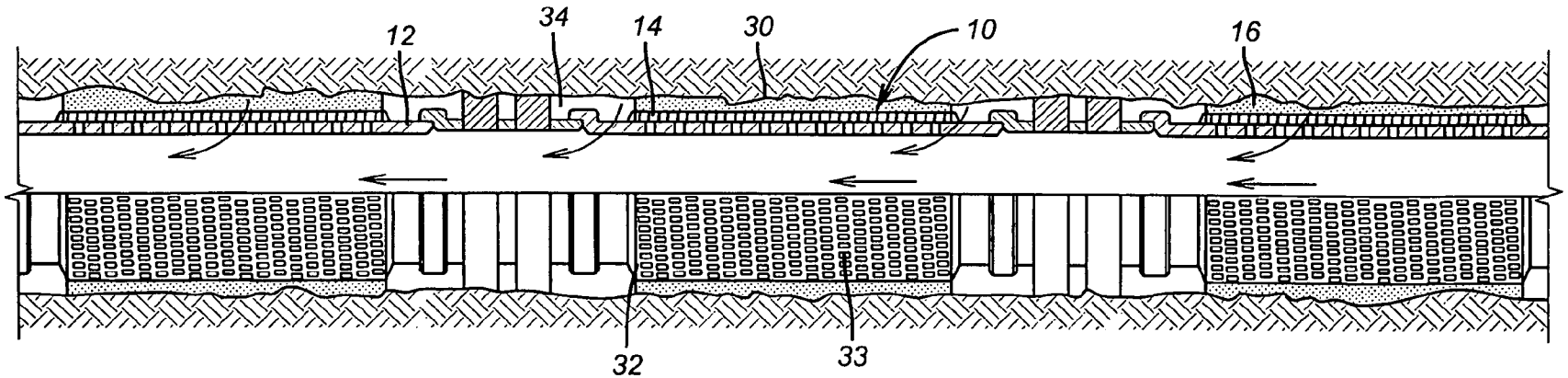
FIG. 2 is a section view of an assembly of screens, one of which is shown in FIG. 1, in the expanded position downhole.
Figure 4:
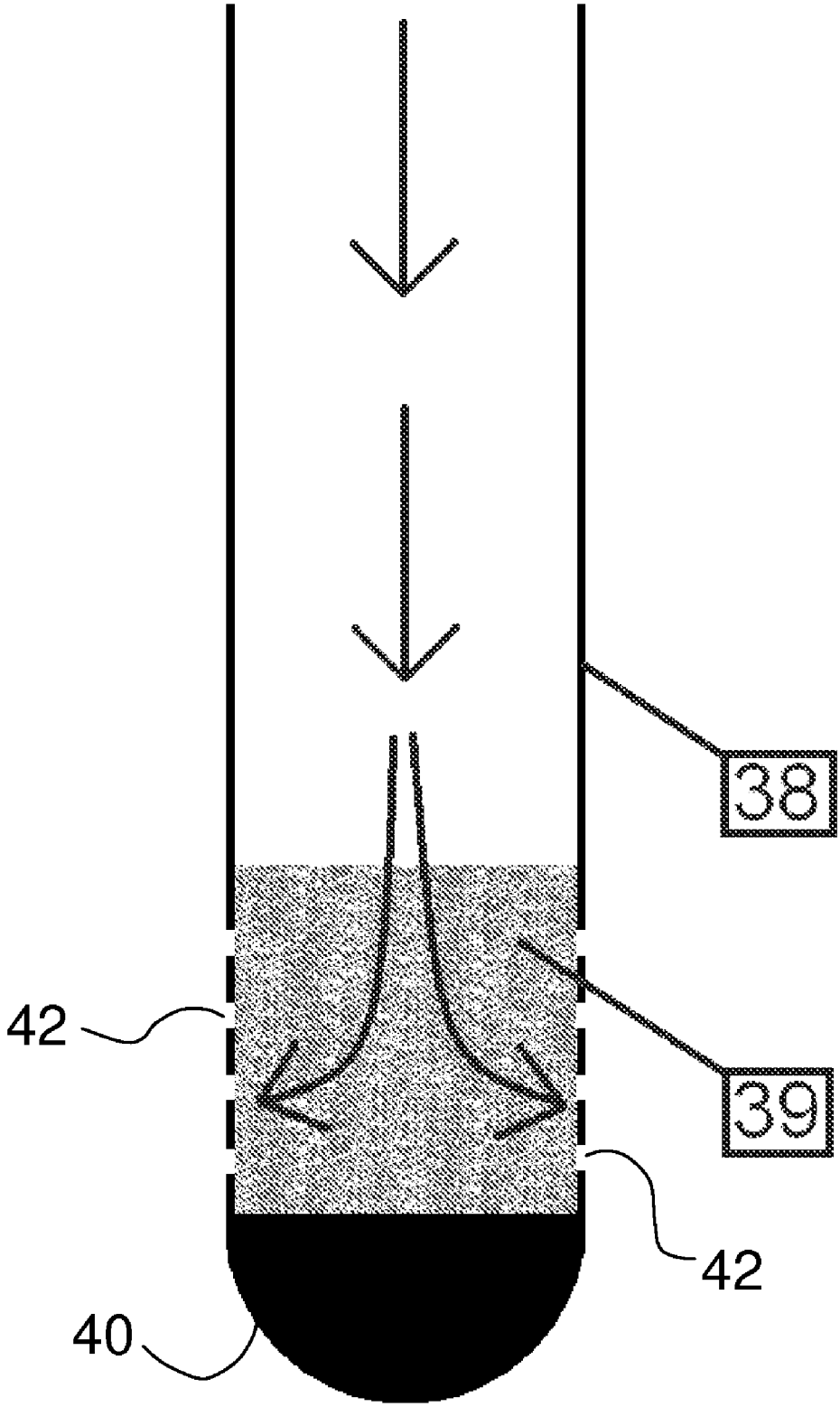
FIG. 4 is a section view of the end of washpipe string containing catalyst.

In a particular aspect of the invention, the deployable screen assembly 10 contains a catalyst that when contacted with fuel will evolve sufficiently high temperature steam to raise the outer conforming layer 16 to its Tg to deploy it in a matter of minutes to bridge the annual gap between the assembly 10 and the borehole 30 wall; please see FIG. 2 for an embodiment where the conforming layer 16 is deployed. This steam evolution may be instantaneous or essentially instantaneous. The catalyst 39 may be placed in a concentric washpipe string 38 which is traditionally run in such applications or can be accommodated in engineered couplings on each joint, as schematically illustrated in FIG. 4. Concentric washpipe string 38 has a bull plug 40 on its closed end, and a plurality of orifices 42 to permit the steam generated by the catalyst 39 to escape string 38 and contact the conforming layer 16. Alternatively, the catalyst may be placed on another structure in relatively close proximity to the screen assembly 10, by which is meant sufficiently close for the evolved steam to effectively contact and deploy the conforming layer 16. In one non-limiting embodiment, the steam evolved should be in the range of from about 110 to about 500° C.; alternatively from a lower threshold of about 150° C. independently to an upper threshold of about 350° C. The overall temperature increase is dependent on the amount of fuel and the length of wellbore interval to be treated.

A number of possible catalysts may be used to evolve high temperature steam sufficiently quickly when contacted with the appropriate fuel. Oxford Catalysts, a UK company spun out of Oxford University, has developed a catalyst, described in U.S. Patent Application No. 2007/0167532 A1 published Jul. 19, 2007, incorporated herein in its entirety by reference, that causes methanol ($CH_3OH$) and hydrogen peroxide ($H_2O_2$) to react exothermically to instantly form steam and carbon dioxide ($CO_2$). The catalyst decomposes the peroxide into water and oxygen, evolving much heat. The oxygen and methanol then react to liberate more heat, water and $CO_2$. Unusually, the steam temperature is independent of the pressure, although it will be appreciated that the relatively instantaneous evolution of steam in a confined space such as the production zone of a wellbore will create pressure. Steam temperatures of about 500-800° C. may be evolved simply by pumping the fuel (methanol and hydrogen peroxide) to contact the catalyst. Steam generation using this catalyst may occur in a volume 25 times smaller than a conventional boiler to generate the same amount of steam. Simplified thermodynamic calculations indicate that as little as 150 gallons (568 liters) of this fuel could raise the temperature of 1,000 feet (305 m) of 6.625 inch (16.8 cm) casing from 150° F. to about 335° F. (65.6-168.8° C.). Since this liberation of heat does not occur until there is contact with a catalyst, the placement of this liberated energy becomes considerably more accurate. U.S. Patent Application No. 2007/0167532 A1 also teaches that other substances can be used as fuels for this steam generation, e.g., $C_1$ to $C_5$ alcohols and combustible hydrocarbons. This document discloses that catalysts of metals of Groups 7, 8, 9, 10, and 11 of the Periodic Table are suitable, for instance a platinum catalyst is expected to be particularly suitable.

U.S. Pat. No. 4,456,069, incorporated by reference herein, teaches the generation of a gas where a reactant, such as hydrogen peroxide, is decomposed by a catalyst to form high temperature decomposition gases, such as steam and oxygen. A silver catalyst is mentioned. In this process, the gas is generated on the surface at relatively high velocity and very high temperature before being injected into a well to elevate the pressure and temperature within the well formation to stimulate the formation through the effects of thermal stress and high pressure gas flow.

Similarly, U.S. Statutory Invention Registration H1948, also incorporated by reference herein, discloses a high-activity hydrogen peroxide decomposition catalyst that includes an impregnated and calcined substrate with catalyst mixture to produce steam and oxygen. The catalyst mixture includes a $H_2O_2$ catalytically active compound containing a transition metal cation mixed with an alkaline promoter. The transition metal may be any of the elements from Groups VB, VIB, VIIB, VII and IB of the Periodic Table of Elements. The alkaline promoter may be any compound which provides a basic solution containing elements from Groups IA and IIA of the Periodic Table of Elements. Preferably, the promoter and transition metal are mixed at a molar ratio of from about 0.5 to about 4.0.

Further, U.S. Pat. No. 6,837,759, additionally incorporated by reference herein, relates to a self-contained propulsion apparatus, such as would be suitable for a sub-sea remotely operated vehicle. The propulsion apparatus contains a fuel and an oxidant that react catalytically to form steam. Various catalysts suitable for use in combustion or oxidation reactions and/or for hydrogen peroxide decomposition are well known in the art. Suitable catalysts disclosed include metals such as platinum, ruthenium and copper, and metal oxides such as cupric oxide (CuO), copper manganese oxide ($CuMn_2O_4$), or manganese oxide (MnO). The catalyst is taught as conveniently supported on alumina ($Al_2O_3$) or carbon. Other suitable supports for the catalyst include silica ($SiO_2$) and titania ($TiO_2$).

Figure 3:
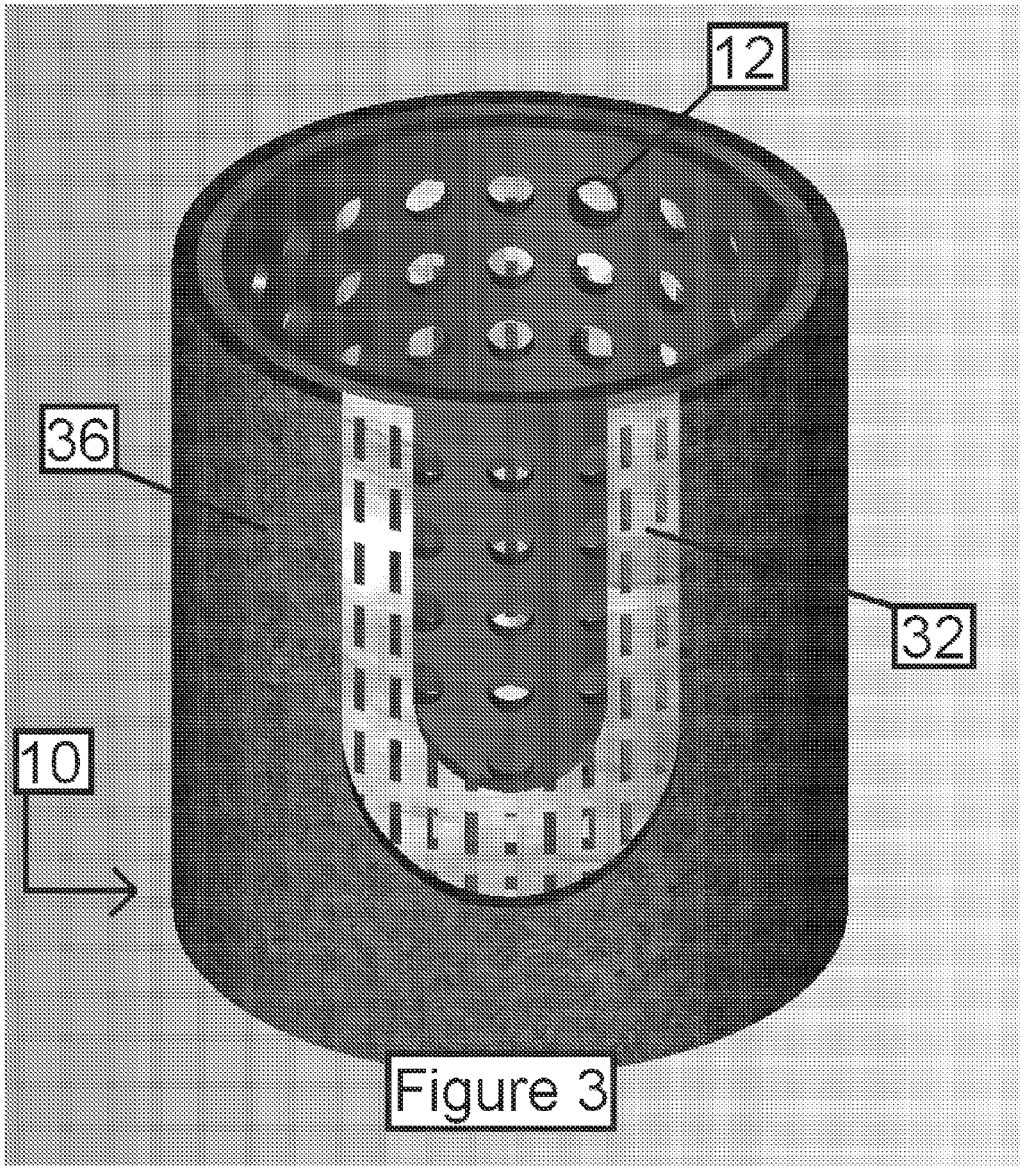
FIG. 3 is a section, cutaway view of an alternative construction of the screen described herein.

The manner of assembly of the screen assembly 10 is another aspect of the invention. The conforming layer 16 may have an internal diameter that allows it to be slipped over the screen material 14. The assembly of the screen material 14 and the conforming layer 16 are slipped over the base pipe 12. Thereafter, a known expansion tool may be applied internally to base pipe 12 to slightly expand it. As a result, the screen material 14 and the conforming layer 16 are both secured to the base pipe 12 without need for welding. This is advantageous because when the screen 10 is run in the wellbore and expanded, the expansion process can put large stresses on welds that may cause screen failure. A non-limiting alternative way to assemble screen 10 is to attach the screen material 14 to the base pipe 12 in the manner just described and then to cure the conforming layer 16 right onto the screen material 14. As another option a protective outer jacket 32, shown in FIG. 3, can be applied over screen material 14 and the conforming layer 36 mounted above. The joining process even with the optional perforated protective jacket 32 is the outward expansion from within the base pipe 12, as previously described.

The holes 18 may have a variety of shapes. Their function is to allow formation fluids to pass after expansion. They can be a foam matrix, round holes or slots or other shapes or combinations of shapes. The conforming layer 16 may be made of a polymeric material and is preferably one that swells on exposure to sufficiently high temperature for effective but relatively short time periods to better conform to irregular shapes in the borehole 30, as shown in FIG. 2. Jacket 32 is a known product that has punched openings 33 and may optionally be used if the conforming layer 16 is used. The reason it is optional is that the conforming layer 16 to some degree provides the desired protection during run in. Additionally, without jacket 32, the conforming layer 16 may be made thicker to better fill in void volume 34 in the annular space around a screen 10 after expansion. The thickness of the conforming layer 16 is limited by the borehole and the outer diameter of the components mounted inside of it. It is acceptable in one embodiment that the conforming layer 16 be squeezed firmly as that promotes its movement to fill voids in the surrounding annular space.

Those skilled in the art will appreciate that the apparatus and method herein allows for fabrication of an expandable screen with welds between layers eliminated. The use of the conforming material 16 allows a variety of expansion techniques to be used and an improvement of the ability to eliminate void spaces outside the expanded screen caused by borehole irregularities. Alternatively, the conforming material 16 may swell sufficiently without downhole expansion of the screen 10 to allow for the elimination of the need to gravel pack. If the material swells due to exposure to fluids downhole, its use as the conforming layer 16 is desired. A protective jacket 32 under the conforming layer 16 may be used as mechanical support for conforming layer 16.

The conforming layer 16 may be a foam that is preferably thermosetting but can also be a thermoplastic if they are porous or may be produced in that condition. The conforming layer 16 is shown with a cylindrical shape, but this may be varied, such as by means of concave ends or striated areas (not shown), to facilitate deployment, or to enhance the filtration characteristics of the layer. In one non-limiting embodiment, the conforming layer 16 may be composed of an elastic memory foam such as an open cell syntactic foam and/or viscoelastic foam. This type of foam has the property of being convertible from one size and shape to another size and/or shape, by changing the temperature of the foam. Other foams expected to be useful in the methods and structures herein include polyurethane foams, epoxy foams, polyethers, polyesters, reticulated polyesters, ester-like-ether polymers, and polyethylene, and combinations thereof. This type of foam may be formed into an article with an original size and shape as desired, such as a cylinder with a desired outer diameter. The foam article thusly formed is then heated to raise its temperature to its transition temperature (Tg). As it achieves the transition temperature, the foam softens, allowing the foam article to be reshaped to a desired interim size and shape, such as by being compressed to form a smaller diameter cylinder. The temperature of the foam article is then lowered below the transition temperature, to cause the foam article to retain its interim size and shape. When subsequently raised again to its transition temperature Tg in position downhole, the foam article will return to its original size and shape.

The cylindrical foam conforming layer 16 may be originally formed onto the screen 10 or the base pipe 12 by wrapping a foam blanket with the desired original outer diameter $OD_1$. Alternatively, the process for forming the conforming layer 16 on the base pipe 12 or screen 10 may be any other process which results in the conforming layer 16 having the desired original diameter, such as by molding the foam directly. The desired original outer diameter $OD_1$ is larger than the bore hole diameter (BHD) in which the assembly will be deployed. For instance, a conforming layer 16 having an original outer diameter $OD_1$ of 10 inches (25.4 cm) might be formed for use in an 8.5 inch (21.6 cm) diameter borehole.

The foam material composition may be formulated to achieve the desired transition temperature (Tg). This quality allows the foam to be formulated in anticipation of the desired transition temperature to be used for a given application. For instance, in use with the present methods and apparatus, the foam material composition may be formulated to have a transition temperature up to just slightly below the anticipated steam temperature to be evolved at the depth at which the assembly will be used. This causes the conforming layer 16 to expand at the steam temperature created locally at the desired depth, and to remain expanded against the bore hole wall once it is cooled. Downhole temperature in conjunction with the steam temperature may be used to expand the conforming layer 16. That is, the conforming material may be formulated to give a material with a particular Tg that takes into account the addition of the downhole temperature to the evolved steam temperature.

The conforming layer 16 may be made to act as the sole filtration agent without the use of any screen material such as 14 or 32. This is because the nature of the conforming material is to be porous, e.g. an open-cell foam. However, a normal technique for its production may be a mold that leaves an impervious coating or layer on the entire outer periphery thereof. This quality allows the material to be used as a packer material essentially in the condition in which it is removed from the mold. However, if the exterior surface that ultimately has contact with the borehole wall has the impervious layer stripped off or otherwise removed, the conforming layer 16 may be mounted to a base pipe 12 or a screen 14 or 32 and it may act solely as the only filtration material or in conjunction with the screen 14. The screen 14 or 32 may be configured exclusively for structural support of the conforming material 16 to keep it from going through the base pipe 12 when well fluids are filtered through it or omitted altogether. The uphole and downhole ends of the conforming material 16 may have the impervious layer from the molding process of manufacturing left on to better direct flow to the openings in the base pipe 12. Alternatively, the impervious layer may be removed to expose pores therethrough.

In the foregoing specification, the invention has been described with reference to specific embodiments thereof, and has been demonstrated as effective in providing methods and apparatus for completing wells by setting screens. However, it will be evident that various modifications and changes can be made thereto without departing from the broader spirit or scope of the invention as set forth in the appended claims. Accordingly, the specification is to be regarded in an illustrative rather than a restrictive sense. For example, specific combinations of conforming materials, catalysts, fuels, and other components falling within the claimed parameters, but not specifically identified or tried in a particular composition or apparatus, are anticipated to be within the scope of this invention.

The terms "comprises" and "comprising" in the claims should be interpreted to mean including, but not limited to, the recited elements.

What is claimed is:

1. A well completion method comprising:

covering at least one base pipe at least partially with a porous conforming material;

running the base pipe with the conforming material to a desired location in a wellbore;

heating the conforming material to deploy it to bridge an annular gap to a wellbore wall, where the heat is provided downhole by a catalytic reaction that produces steam, where the catalytic reaction comprises contacting a catalyst with hydrogen peroxide and methanol, whereby steam and carbon dioxide are produced; and filtering fluids through the conforming material to the base pipe.

2. The method of claim 1 where the porous conforming material is a foam.

3. The method of claim 2 where the porous conforming material is a shape memory foam.

4. The method of claim 1 where the porous conforming material is a thermosetting material.

5. The method of claim 1 where the porous conforming material is a thermoplastic material.

6. The method of claim 1 further comprising providing a support member between the base pipe and the conforming material.

7. The method of claim 6 where the support member is a screen.

8. The method of claim 1 further comprising, where in heating the conforming material to deploy it to bridge an annular gap to a wellbore wall, the bridging is performed by allowing the conforming material to swell into contact with the wellbore wall.

9. A well completion method comprising:

covering at least one base pipe at least partially with a porous conforming material;

running the base pipe with the conforming material to a desired location in a wellbore;

heating the conforming material to deploy it to bridge an annular gap to a wellbore wall without a base pipe expansion, where the heat is provided downhole by a catalytic reaction comprising contacting a catalyst with hydrogen peroxide and methanol, and whereby steam and carbon dioxide are produced; and filtering fluids through the conforming material to the base pipe.

10. The method of claim 9 where the porous conforming material is a foam.

11. The method of claim 9 where the porous conforming material is selected from the group consisting of a thermosetting material, a thermoplastic material and mixtures thereof.

12. A deployable screen assembly comprising:

a base pipe covered at least partially with a porous conforming material, where the porous conforming material deploys in the presence of heat; and a catalyst in proximity to the porous conforming material, where the catalyst is capable of generating the heat for the porous confirming material deployment upon contact with a fuel comprising methanol and hydrogen peroxide.

13. The deployable screen assembly of claim 12 where the porous conforming material is a foam.

14. The deployable screen assembly of claim 13 where the porous conforming material is a shape memory foam.

15. The deployable screen assembly of claim 12 where the porous conforming material is a thermosetting material.

16. The deployable screen assembly of claim 12 where the porous conforming material is a thermoplastic material.

17. The deployable screen assembly of claim 12 further comprising a support member between the base pipe and the conforming material.

18. The deployable screen assembly of claim 17 where the support member is a screen.

19. A deployable screen assembly comprising:

a base pipe covered at least partially with a porous conforming foam, where the porous conforming foam deploys in the presence of heat; and a catalyst in proximity to the porous conforming material, where the catalyst is capable of generating the heat for the porous conforming material deployment upon contact with a fuel comprising hydrogen peroxide and methanol.

20. The deployable screen assembly of claim 19 where the porous conforming material is a shape memory foam.

21. The deployable screen assembly of claim 19 where the porous conforming material is selected from the group consisting of a thermosetting material or a thermoplastic material and mixtures thereof.

* * * * *